US005558215A

United States Patent [19]

Steigerwald et al.

[11] Patent Number: 5,558,215

[45] Date of Patent: Sep. 24, 1996

[54] ARRANGEMENT FOR MIXING TWO COMPONENTS

[75] Inventors: Franz Steigerwald, Griesheim; Martina Schmitt, Gernsheim; Gabriele Bock, Darmstadt, all of Germany

[73] Assignee: Wella Aktiengesellschaft, Darmstadt, Germany

[21] Appl. No.: 551,650

[22] Filed: Nov. 1, 1995

[30] Foreign Application Priority Data

Nov. 11, 1994 [DE] Germany ..... 44 40 264.3

[51] Int. Cl.[6] ..... B65D 25/08; B65D 81/32

[52] U.S. Cl. ..... 206/222; 215/DIG. 8

[58] Field of Search ..... 206/219, 222, 206/532; 215/DIG. 8

[56] References Cited

U.S. PATENT DOCUMENTS 4,247,001 1/1981 Wiegner ..... 206/222

4,858,760 8/1989 Di Sturco ..... 206/222

FOREIGN PATENT DOCUMENTS 3924152 7/1989 Germany .

4219063 6/1992 Germany .

*Primary Examiner*—Jacob K. Ackun

*Attorney, Agent, or Firm*—Michael J. Striker

[57] ABSTRACT

An arrangement for mixing two components has a vessel, a cover element placed on the vessel and having an upper region provided with a recess having an edge, at least one cutting mandrel provided on the edge of the recess, and a releasable depot vessel inserted in the recess of the cover element and having a foil at a side of the vessel. The depot vessel has a lower inner diameter which is greater than a double distance between a central axis of the depot vessel and the cutting mandrel.

9 Claims, 3 Drawing Sheets

ARRANGEMENT FOR MIXING TWO COMPONENTS

BACKGROUND OF THE INVENTION

The present invention relates to an arrangement for mixing two components.

Arrangements for mixing two components including a vessel with a connecting element and a cover element which is placed on the vessel are known in different embodiments. It is known for example to use caps which are placed in the position on a threaded neck of a vessel through a screwing movement of a screwing element and separated by the foils inserted in the vessel.

One of such arrangements is disclosed for example in the German patent document DE-PS 39 24 152. A cover element is used here in form of a cap provided with a tooth which extends into the threaded neck of a container. During a screwing movement of the cap the tooth cuts through a foil in the threaded neck. The foil separates two different components which, for example, are two liquids or a liquid and a powder material. Therefore, during the separation of the foil and the shaking of the container, a mixture of both components is formed.

The German document DE-OS 42 19 063 discloses an arrangement for mixing two components which has an upwardly open vessel with a screw thread as a connecting element, a collar element which is screwable on the vessel, a cutting mandrel provided in the region of the upper edge of the open vessel, and a releasable depot vessel inserted in the screw element. A foil of the depot vessel can be separated with the cutting mandrel of the open vessel.

The utilization of such arrangement is recommended, for example, for separate storage of liquid components which must be fixed shortly before their use. A mixture of the individual components is then processed over a certain time, such as for example the components including permanent wave solution and esther for a hair treatment. Such arrangements can also be used for separate preparation of a powder product and a liquid. Because of the dissolution of the powder products, for example a natural hair dye powder, in the liquid, no dust is produced which can be of disadvantage to a user.

The known arrangements, however, have the disadvantage that they are relatively complicated handle or not suitable for at least partial reuse. They are also not suitable for the use of relatively small, exchangeable depot vessels.

SUMMARY OF THE INVENTION

Accordingly, it is an object of the present invention to provide an arrangement for mixing two components, which avoids the disadvantages of the prior art.

In keeping with these objects and with others which will become apparent hereinafter, one feature of the present invention resides, briefly stated, in an arrangement for mixing two components, in which in the region of the cover element a recess with at least one cutting mandrel is provided at the edge of the recess, and a releasable depot vessel is inserted in the recess with a foil separable at the vessel side, and the lower inner diameter of the depot vessel is greater than the double distance between the central axis of the depot vessel and the cutting mandrel.

When the arrangement is designed in accordance with the present invention, the depot vessel is placed in the recess of the cover element, then the cover element is fixedly screwed on the vessel. During placement of the depot vessel on the cover element, the cutting mandrel arranged on the cover element pierces the foil of the depot vessel. Thereby a product component accommodated in the depot vessel passes into the vessel located underneath to a second product component accommodated in it. The whole arrangement for mixing the product components is hermetically closed. The mixing of both product components can be improved by shaking the arrangement.

The inventive arrangement is constructed relatively simple and therefore can be produced inexpensively. The vessel and the screw element can be produced by injection molding, and the depot vessel can be made in the same way. The foil for the depot vessel can be connected with it for example by hot sealing. The vessel and the cover element can be again used after their cleaning with a new depot container. The restoration of the operability of the arrangement is possible by a user without problems, since instead of an emptied depot vessel a new, filled depot vessel must be plugged into the screw element. The diameter of the recess can be relatively small, so that also small depot vessels can be utilized.

In accordance with a further feature of the present invention, the recess extends substantially more than a three-fourth circle. With this construction the foil is not completely separated from the depot vessel and does not fall into the vessel located underneath, in which both product containers are mixed.

Still another feature of the present invention is that the foil is a synthetic plastic-coated aluminum foil. With this construction the both components are separated by a foil so that on the base of the aluminum layer very good barrier properties with respect to a product diffusion are obtained. Also, the base of the synthetic plastic coating (for example the same synthetic plastic as the depot vessel) can be sealed on the edge of the depot vessel.

An especially simple handling of the inventive arrangement is provided when the depot vessel is clamped in a form-locking manner in the cover element. An emptied depot vessel can be pulled out from the cover element, and a new depot vessel can be plugged into the cover element.

In accordance with still another feature of the present invention a seal is provided on the edge of the vessel. During screwing of the cover element on the edge of the vessel, pressure is applied on the sealing and thereby the inner space of the vessel is hermetically closed. Also, during shaking and turning of the screwed arrangement, no fluid can escape from the arrangement.

The depot vessel can be composed of injection molded synthetic plastic material. With such an approach, the depot vessel can be produced with especially accurate dimensions.

The depot vessel can be provided with gripping surfaces. Therefore the plugging of the depot vessel onto the cover element and a rotation of the depot vessel are simplified.

The plan in which the recess is located can be inclined relative to the bottom surface of the vessel. As a result, the shaking condition from the depot vessel into the vessel is improved.

The cutting edge of the cutting mandrel can be located in the area of the engaging region of the depot vessel. It is therefore possible to open the depot vessel by the cutting edge during the insertion of the depot vessel.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
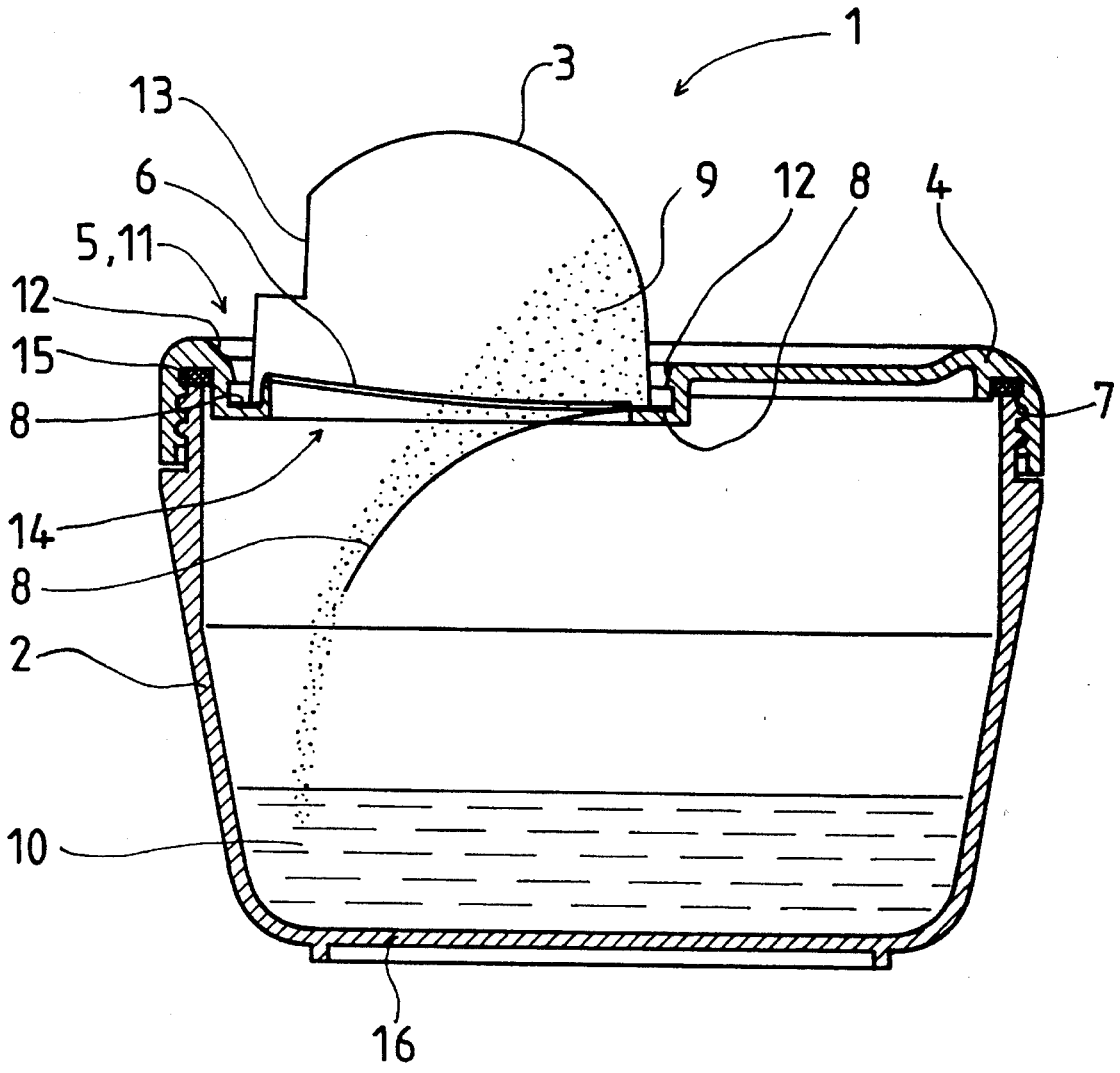
FIG. 1 is a view showing a vertical section of an arrangement for mixing two components, in accordance with the present invention, including a vessel with a screw thread, a cover element screwed on the vessel and having a recess, a cutting mandrel and a depot vessel plugged on the cutting mandrel above the recess.

An arrangement for mixing two components in accordance with the present invention includes an open vessel 2, a depot vessel 3 and a cover element 4 shown in FIG. 1.

A cutting mandrel 6 is arranged in an upper region 5 of the cover element 4. The vessel 2 is provided with an outer thread 7 in its upper region. The depot vessel 3 is closed with a foil 8. A powdery component 9 is accommodated in the depot vessel 3. A liquid component 10 is accommodated in the vessel 2. A mixing of the powdery component 9 from the vessel 2 with the liquid component 10 from the vessel 2 forms a solution which is ready to use.

Figure 3:
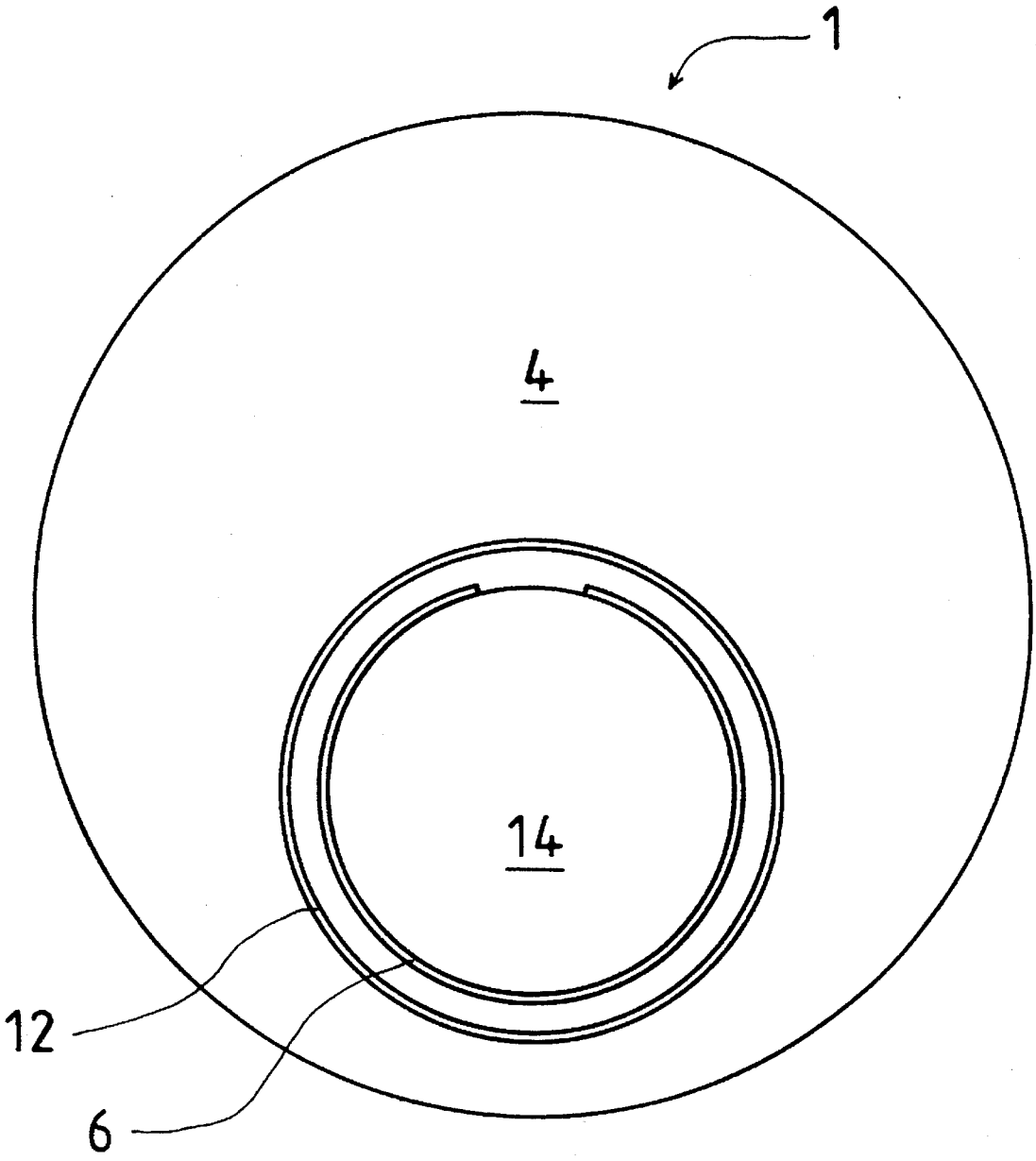
FIG. 3 is a plan view of the arrangement of FIG. 1, but without the depot vessel.

For introducing the powdery component 9 into the liquid component 10, the depot vessel 3 is plugged in the engaging region 11. Therefore the foil 8 of the depot vessel 3 engages around the inclined arresting ring 12 of the cover element 4. The depot vessel 3 is turned by means of the dripping surface 13 so as to apply pressure, and the cutting mandrel 6 cuts circularly through the foil 8. The powdery component 9 falls through a recess 14 of the cover element 4 into the liquid component 10. The cutting mandrel 6 extends over more than one third of the circle around the recess 14 as can be seen from FIG. 3. When the powdery component 9 is introduced in the liquid component 10, the arrangement can be shaken for better mixing of the components with one another. A ring shaped circular seal 15 is located between the cover element 4 and the open vessel 2 as shown in FIG. 1. Therefore, a liquid escape is reliably prevented during shaking.

Figure 2:
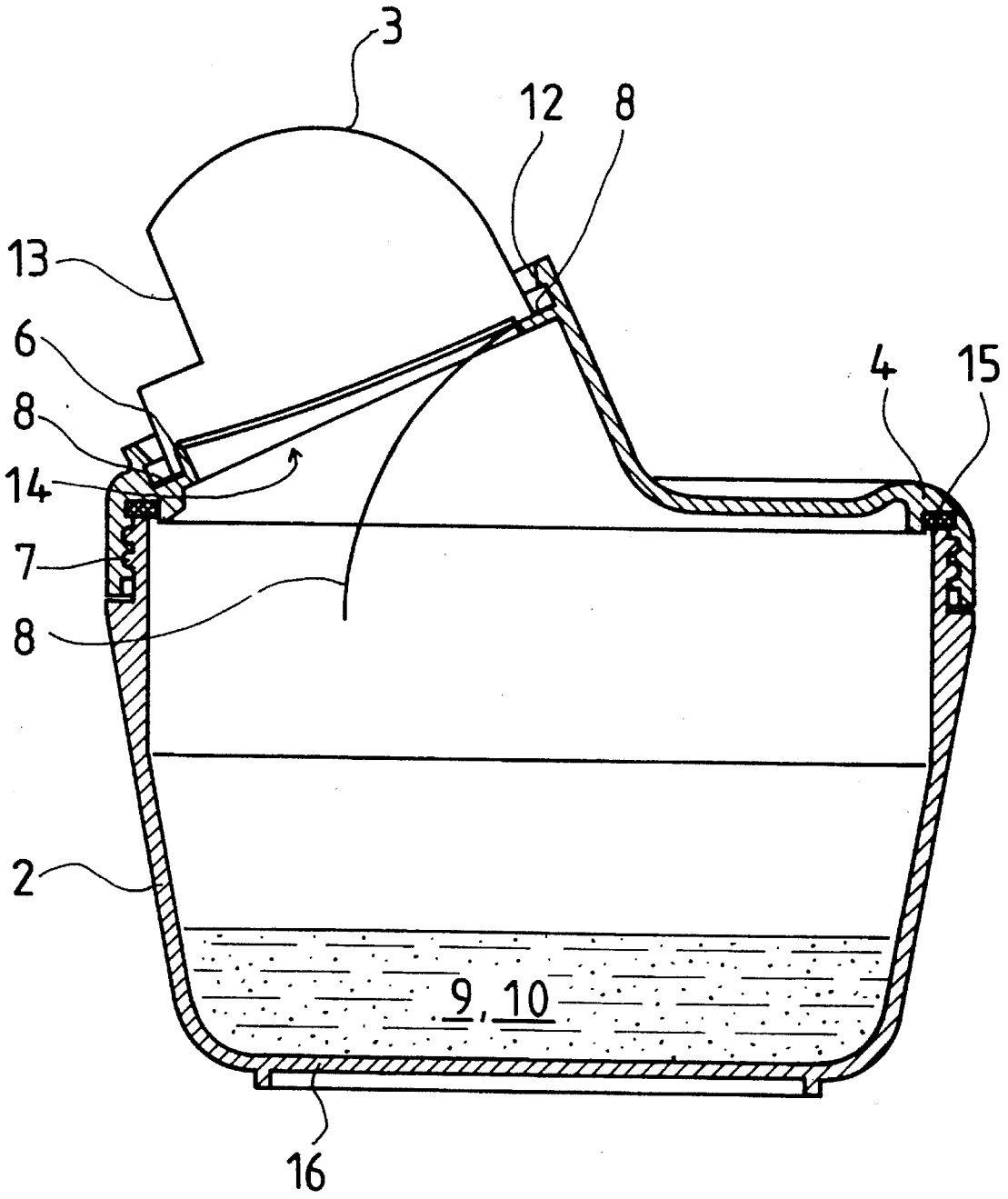
FIG. 2 is a view showing a vertical section of an arrangement for mixing two components, which is analogous to the arrangement of FIG. 1 but has an inclination of the recess relative to the bottom surface of the vessel.

Another embodiment of the inventive arrangement is shown in FIG. 2. In the arrangement in accordance with this embodiment the plane in which the recess 14 is located is inclined relative to a bottom surface 16 of the open vessel 2. Thereby after the cutting process, the component 9 better empties in direction toward the component 10.

The foil 8 can be formed as a synthetic plastic-coated aluminum foil. The depot vessel 3 can be clampable in the cover element 4 in a form-locking manner. The depot vessel 3 can be composed of an injection molded synthetic plastic material. The cutting edge of the cutting mandrel 6 can be located in the area of the engaging region 11 of the depot vessel.

It will be understood that each of the elements described above, or two or more together, may also find a useful application in other types of constructions differing from the types described above.

While the invention has been illustrated and described as embodied in an arrangement for mixing two components, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is desired to be protected by Letters Patent is set forth in the appended claims.

We claim:

1. An arrangement for mixing two components, comprising a vessel provided with connecting means; a cover element placed on said vessel and having an upper region, said cover element being provided in said upper region with a recess having an edge; at least one cutting mandrel provided on said edge of said recess; a releasable depot vessel inserted in said recess of said cover element and having a foil at a side of said vessel, said depot vessel having a lower inner diameter which is greater than a double distance between a central axis of said depot vessel and said cutting mandrel.

2. An arrangement as defined in claim 1, wherein said cutting mandrel for cutting through said foil extends substantially over more than three-quarters of a circle around said recess.

3. An arrangement as defined in claim 1, wherein said foil is a synthetic plastic-coated aluminum foil.

4. An arrangement as defined in claim 1, wherein said depot vessel is clamped in said cover element in a form-locking manner.

5. An arrangement as defined in claim 1; and further comprising a seal provided on an edge of said vessel.

6. An arrangement as defined in claim 1, wherein said depot vessel is composed of an injection molded synthetic plastic material.

7. An arrangement as defined in claim 1, wherein said depot vessel is provided with a gripping surface.

8. An arrangement as defined in claim 1, wherein said recess is located in a plane which is inclined relative to a bottom surface of said vessel.

9. An arrangement as defined in claim 4, wherein said cutting mandrel has a cutting edge located in an area of an engaging region of said depot vessel.

* * * * *